US006857294B2

(12) United States Patent
Okamoto

(10) Patent No.: US 6,857,294 B2
(45) Date of Patent: Feb. 22, 2005

(54) METHOD FOR KNITTING INTARSIA PATTERN KNITTING FABRIC AND KNITTING PROGRAM PRODUCING DEVICE THEREFOR

(75) Inventor: Kazuyoshi Okamoto, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/478,860

(22) PCT Filed: May 23, 2002

(86) PCT No.: PCT/JP02/04978

§ 371 (c)(1),
(2), (4) Date: Nov. 25, 2003

(87) PCT Pub. No.: WO02/097178

PCT Pub. Date: Dec. 5, 2002

(65) Prior Publication Data

US 2004/0172981 A1 Sep. 9, 2004

(30) Foreign Application Priority Data

May 25, 2001 (JP) ..... 2001-156644

(51) Int. Cl.[7] ..... D04B 7/04; D04B 15/66
(52) U.S. Cl. ..... 66/64; 66/231
(58) Field of Search ..... 66/231, 232, 237, 66/238, 64–71

(56) References Cited

U.S. PATENT DOCUMENTS 5,417,087 A * 5/1995 Marcello, Baseggio ..... 66/64
5,758,518 A * 6/1998 Shu et al. ..... 66/64
5,819,558 A 10/1998 Takegawa et al.
6,047,570 A * 4/2000 Shima ..... 66/126 R

FOREIGN PATENT DOCUMENTS

| | | |
|---|---|---|
| EP | 0 641 879 | 3/1995 |
| EP | 0754792 | 1/1997 |
| GB | 2 310220 | 8/1997 |
| JP | 61-23300 | 6/1986 |
| JP | 61-51061 | 11/1986 |
| JP | 3-75656 | 12/1991 |
| JP | 9-31804 | 2/1997 |
| JP | 10-1852 | 1/1998 |

* cited by examiner

*Primary Examiner*—Danny Worrell
(74) *Attorney, Agent, or Firm*—Wenderoth, Lind & Ponack L.L.P.

(57) ABSTRACT

An object of the invention is to obtain an intarsia pattern fabric which is not likely to cause yarn entanglement, eliminates the need for divided knitting, and provides good productivity even when a cylindrical knitting fabric is to be knitted. in a double bed flat knitting machine, a carriage and an intarsia carrier capable of knitting with two sets of cams are used to knit two courses of knitting fabric by moving a carriage six courses. An intarsia pattern is knitted at a front needle bed FB, and a knitting yarn between the intarsia carrier halted near a boundary and a knitting needle F is used to perform kick-back of the intarsia carrier by the third-course movement of the carriage. A back body is knitted while the yarn is hooked on an unused knitting needle F in a back needle bed BB. The sixth-course movement of the carriage releases a knitting yarn from the knitting beed F in the back needle bed BB while the back body is being knitted.

5 Claims, 8 Drawing Sheets

(a)

◆ INTARSIA KNITTING WITH NORMAL CARRIERS (b)

◆ INTARSIA KNITTING WITH INTARSIA CARRIERS

METHOD FOR KNITTING INTARSIA PATTERN KNITTING FABRIC AND KNITTING PROGRAM PRODUCING DEVICE THEREFOR

TECHNICAL FIELD

The present invention relates to a method for knitting an intarsia pattern knitting fabric for inserting an intarsia pattern while knitting garments such as sweaters in the form of a cylindrical seamless knitting fabric, and an apparatus for generating a knitting program thereof.

BACKGROUND ART

An intarsia pattern knitting fabric as shown in FIG. 7 has been conventionally known as a typical knitting fabric knitted by a flat knitting machine. FIG. 7(*a*) shows an example in which an intarsia pattern knitting fabric 3 with a diamond pattern is knitted in a part of the front body 2 of a sweater 1, and other portions are made of a ground knitting fabric 4. This sweater 1 can be produced seamless as a cylindrical knitting fabric by knitting a back body opposing a front body 2 in parallel to the front body so that the front and back bodies are joined at both ends. In lower portions of the front body 2 and the back body, a rib knitting fabric 5 called a bottom rib is knitted. FIG. 7(*b*) shows an example in which an intarsia pattern knitting fabric 8 of a vertically striped pattern is knitted in a part of the front body 7 of a sweater 6, and other portions are made of a ground knitting fabric 9.

FIG. 8 shows the basic manner in which a knitting needle is used when knitting a cylindrical knitting fabric including the intarsia pattern knitting fabrics 3 and 8 shown in FIG. 7 with a double bed flat knitting machine having a front needle bed FB and a back needle bed BB. The intarsia pattern knitting fabrics 3 and 8 and the ground knitting fabrics 4 and 9 are knitted using yarns fed from the tips of different yarn carriers. In the front needle bed FB and the back needle bed BB, knitting is performed using knitting needles A, B, C, . . . shown by capital letters for the front bodies 2 and 7 and knitting needles a, b, c, . . . shown by lower-case letters for the back bodies. Therefore, when a yarn as shown by a solid line is used in the portions of the intarsia pattern 3 and 8, a different yarn from that for the intarsia pattern knitting fabrics 3 and 8 is used for the ground knitting fabrics 4 and 9, as shown by a broken line.

FIG. 9 shows a schematic cross-sectional structure of a double bed flat knitting machine 10 that can knit a cylindrical seamless knitting fabric as shown in FIG. 7. In the double bed flat knitting fabric 10, the front needle bed FB and the back needle bed BB are arranged with a tooth mouth 11 interposed therebetween, and include a large number of knitting needles 12 and 13 that can proceed and recede with respect to the tooth mouth 11. The knitting needles 12 and 13 are arranged with an equal pitch in the direction perpendicular to the drawing sheet. A plurality of thread guide rails 14 are suspended so that a plurality of yarn carriers 15 can travel. A carriage 16 can move in the direction perpendicular to the drawing sheet and is provided with a cam mechanism for moving the knitting needles 12 and 13 in the front needle bed FB and the back needle bed BB selectively in the direction parallel to the drawing sheet, and for driving a knitting operation. The carriage 16 couples the front and back needle beds at a bridge portion 17. The bridge portion 17 is provided with a transfer pin 18 so that the pin can emerge and submerge. The transfer pin 18 is engaged with the yarn carrier 15 in the projected state and allows the yarn carrier 15 to travel along the thread guide rail 14, led by the movement of the carriage 16.

When knitting the intarsia pattern knitting fabrics 3 and 8 as shown in FIG. 7, a plurality of thread feeding members such as the yarn carriers 15 are used for feeding yarns as shown in FIG. 8 for the intarsia pattern knitting fabrics 3 and 8 and the ground knitting fabrics 4 and 9. The thread feeding member such as the yarn carrier 15 used for knitting the intarsia pattern portions 3 and 8 is halted near a boundary between the intarsia pattern knitting fabrics 3 and 8 and the ground knitting fabrics 4 and 9 in each knitting course in order to be used again for knitting the intarsia pattern knitting fabrics 3 and 8 in the next course. In other words, different thread feeding members are used for knitting the adjacent knitting fabrics sandwiching the boundary. Therefore, the plurality of yarn carriers 15 are jammed near the boundary between the intarsia pattern knitting fabrics 3 and 8 and the ground knitting fabrics 4 and 9. As a result, the yarn carriers 15 may interfere with each other, and the tip of a knitting needle supplied for the knitting operation may collide against a halted yarn carrier 15. Alternatively, yarn entanglement may occur, that is, a yarn extending from the final stitch of the intarsia pattern knitting fabrics 3 and 8 to a halted yarn carrier is caught by the tip of the knitting needle 12 or 13 when knitting the ground knitting fabrics 4 and 9 adjacent to the intarsia pattern knitting fabrics 3 and 8.

In order to solve such a problem, a thread feeding member for intarsia pattern knitting that can swing and displace a yarn feeding portion of the thread feeding member forward and backward in the traveling direction when knitting the intarsia pattern is considered. For example, the present inventor discloses a structure of a thread guiding apparatus as a thread feeding member that can swing and displace a yarn feeding portion at the tip of the thread feeding member and can be in a state in which the yarn is extending in the direction substantially immediately above from the final stitch when it is halted, and a method for knitting an intarsia pattern, in Japanese Examined Patent Publication JP-B2 61-51061 (1986). When a thread feeding member in which the position of the yarn feeding portion is changed is used, a plurality of intarsia patterns can be inserted when knitting one course with a carriage provided with a plurality of sets of cams for each needle bed. Furthermore, Japanese Examined Patent Publication JP-B2 61-23300 (1986) discloses a related technique that avoids interference between thread guiding apparatuses as thread feeding members by displacing a lower portion having a hole that can guide the yarn in the vertical direction such that the lower portion penetrates the gap between the knitting needles.

FIG. 10(*a*) shows a case in which when knitting the intarsia pattern 20 divided into three sections 20*a*, 20*b*, and 20*c*, normal carriers 21*a*, 21*b*, and 21*c* in which the yarn feeding portions 26*a*, 26*b* and 26*c* of the thread feeding member are not displaced are used. FIG. 10(*b*) shows a case in which intarsia carriers 22*a*, 22*b*, and 22*c* in which the yarn feeding portions 27*a*, 27*b* and 27*c* of the thread feeding member are displaced are used. As shown in FIG. 10(*a*), when knitting the intarsia pattern 20 from the left to the right with the normal carriers 21*a*, 21*b* and 21*c*, if one set of knitting cams is provided with the carriage for each needle bed, knitting is started from the section 20*c* with the normal carrier 21*c* on the right side, then knitting is performed in the section 20*b* with the intermediate normal carrier 21*b*, and finally knitting is performed in the section 20*a* with the normal carrier 21*a* on the left side. The carriage has to make movement including a plurality of reverse movements. This is because the start positions of the normal carriers 21*b* and 21*c* are present in the sections 20*a* and 20*b* on their left, and when knitting is performed earlier in the sections 20*a* and 20*b* on their left, yarns 28 extending from the normal carriers 21*b* and 21*c* at the start positions to the first stitch of the sections 20*b* and 20*c* may be caught when knitting the sections 20*a* and 20*b*.

In the intarsia carriers 22*a*, 22*b*, and 22*c* shown in FIG. 10(*b*), in the start positions, yarns 29 extending from the intarsia carriers 22*b* and 22*c* present in the sections 20*a* and 20*b* on their left to the first stitch in the sections 20*b* and 20*c* can extend substantially immediately above by swinging and displacing the yarn feeding portions 27*b* and 27*c*. The yarns 29 substantially do not enter the sections 20*a* and 20*b* on their left, so that the yarns are not caught even if knitting is performed earlier in the sections 20*a* and 20*b* on their left. This is because when knitting in the sections 20*a* and 20*b* on their left, even if the positions of the intarsia carriers 22*b* and 22*c* are present in the sections 20*a* and 20*b*, the yarn feeding portions 27*b* and 27*c* are swung and displaced so that the yarns 29 extend substantially immediately above. Therefore, when the intarsia carriers 22*a*, 22*b*, and 22*c* are used, it is possible to knit the intarsia pattern 20 from the left to the right by one movement of the carriage.

In recent years, a technique for producing a seamless product by knitting a garment such as a sweater in the form of a cylinder using a flat knitting machine as shown in FIG. 7 has been developed. The present inventor teaches a method for knitting a fabric employing the front and back needle beds, such as rib knitting, in the form of a cylinder by allocating alternately the knitting needle of each needle bed to the front and back knitting fabric, using a double bed flat knitting machine, in Japanese Examined Patent Publication JP-B2 3-75656 (1991). Furthermore, Japanese Unexamined Patent Publication JP-A 10-1852 (1998) discloses a method for knitting a cylindrical knitting fabric having an intarsia portion.

Japanese Unexamined Patent Publication JP-A 10-1852 discloses two methods for knitting a cylindrical fabric in which an intarsia pattern is designed in the front knitting fabric, not using a thread feeding member dedicated for intarsia provided with a function in that a yarn feeding portion is displaced as shown in FIG. 10(*b*). However, a thread feeding member in which a yarn feeding portion is fixed as shown in FIG. 10(*a*) is used. In a first embodiment shown in FIG. 2 of this publication, even if there is no intarsia pattern in the back body in the back needle bed, the back body is knitted in a divided manner in accordance with the boundary portion of the intarsia pattern of the front body, and the thread feeding member is reversed in the course of knitting and return knitting. Therefore, interference between the thread feeding members and yarn entanglement are prevented. In other words, when knitting a course for the ground portion opposing the intarsia pattern, (1) a kick-back of moving the yarn carrier for an intarsia pattern to the inside of the range of the intarsia pattern is performed, and then the ground portion is knitted all the way up to the intarsia pattern, and (2) a kick-back of moving the yarn carriers for an intarsia pattern and a ground portion to outside the range of the intarsia pattern is performed, and then the remaining ground portion is knitted. Furthermore, in a second embodiment shown in FIG. 3 in this publication, it is attempted to prevent interference and yarn entanglement by retracting the thread feeding member used for knitting the intarsia pattern of the front body to the outside of the width of the entire knitting fabric, when knitting the back body.

In the first embodiment disclosed in Japanese Unexamined Patent Publication JP-A 10-1852, return knitting is performed when knitting the back body. As described in paragraph of this publication, stitches are dense in a portion in which the thread feeding member makes a reverse movement in the return knitting, so that the appearance of the knitting fabric may deteriorate. This problem may be solved by decreasing the stitch density in the reverse movement portion, but adjustment is difficult and takes time. Furthermore, since the back body is not knitted without a break but has to be knitted in a divided manner, the productivity is low. In the second embodiment, although there is no need of performing return knitting, it is necessary to feed the yarn to the thread feeding member directly from the above, as described above in paragraph of this publication, so that the manner of feeding the thread is limited and a large number of colors cannot be taken.

When the thread feeding member for intarsia knitting as disclosed in Japanese Examined Patent Publication JP-B2 61-51061 is used, there is no limitation regarding the number of colors or the manner of feeding the thread, and adjustment of the stitch density involved in return knitting is not necessary. However, it is known that the problem of yarn entanglement is not necessarily solved. Even if the yarn feeding portion of the thread feeding member is displaced, the precision of the position in which it stops in the boundary portion of the intarsia pattern is not necessarily sufficient.

FIG. 11 shows a state in which the final stitch of the intarsia pattern is formed with a knitting needle F in the front needle bed FB, for example, and the yarn feeding portion 22 of the intarsia carrier is halted. In the knitting needles F and G, a new loop of the intarsia pattern is formed by a yarn 23, and an old loop 24 is knocked over. If the yarn feeding portion 22 of the intarsia carrier stops at a position in the range A, for example, it can be believed that yarn entanglement does not occur in which a yarn 25 extending from the knitting needle F of the front needle bed FB to the yarn feeding portion 22 is caught by a knitting needle e of the back needle bed BB. This is because there is a difference in height between the yarn feeding portion 22 and the knitting needle F. Therefore, the range A is extended up to a position slightly beyond a point immediately above the knitting needle e. However, it is difficult to halt the yarn feeding portion 22 within the range A because of the halt precision. As shown in FIG. 9, the yarn carrier 15 is a type in which travel led by the carriage 16 along the thread guiding rail 14 suspended above the tooth mouth 11 can be switched between a travel state and a halt state by being engaged with the transfer pin 18 emerging from or submerging into the bridge portion 17 of the carriage 16. When the engagement with the transfer pin 18 is released, the yarn carrier 15 is halted in the middle of the thread guiding rail 14. The characteristics that are difficult to achieve are required, that is, the sliding resistance between the yarn carrier 15 and the thread guiding rail 14 is small to facilitate the movement when being led by the carriage 16, and when not being led by the carriage 16, the movement should not be facilitated. A lubricant is applied to reduce the sliding resistance, and an adsorptive power by a magnet can be utilized in order to increase the braking properties. However, it is difficult to significantly increase the halt precision of the yarn carrier. Therefore, even using the intarsia carriers 22*a*, 22*b* and 22*c*, the yarn feeding portion 22 cannot stay within the range A in which yarn entanglement hardly occurs, and the yarn feeding portion 22 is halted outside the range A, so that yarn entanglement easily occurs.

SUMMARY OF THE INVENTION

It is an object of the invention to provide a method and an apparatus for knitting an intarsia pattern knitting fabric that hardly causes yarn entanglement, eliminates divided knitting, and provides a good productivity.

The invention provides a method for knitting an intern pattern knitting fabric using a flat knitting machine in which the tooth mouth (i.e., needle gap) is formed between a plurality of opposing needle beds, for knitting a cylindrical knitting fabric in which a front knitting fabric and a back knitting fabric are joined on both ends with an intarsia pattern inserted, using a plurality of thread feeding members for feeding yarns to the tooth mouth while traveling in a longitudinal direction of the needle beds. The method includes providing the flat knitting machine with a function for intarsia knitting for displacing a position at which a yarn is fed from the thread feeding member to the tooth mouth during the intarsia knitting; and halting the thread feeding member for feeding the yarn used for knitting near a final stitch of the intarsia pattern after knitting the intarsia pattern. A knitting fabric opposing a knitting fabric into which the intarsia pattern is knitted, is knitted in a state in which a yarn extending from a knitting needle holding the final stitch of the intarsia pattern to the yarn feeding portion of the thread feeding member is hooked on an unused knitting needle that is on a needle bed opposing a needle bed to which the knitting needle belongs. The hooked yarn is released after knitting the knitting fabric opposing the knitting fabric into which the intarsia pattern is knitted.

The invention is characterized in that the cylindrical knitting fabric is knitted by allocating knitting needles of each needle bed alternately for knitting a front knitting fabric and for knitting a back knitting fabric in a double bed flat knitting machine in which one needle bed is arranged each before and after the tooth mouth. Further, the invention is characterized in that a knitting needle that belongs to a needle bed opposing a needle bed to which a knitting needle holding the final stitch and is located near the knitting needle is used as the unused knitting needle.

Further, the invention is characterized in that a carriage provided with a plurality of sets of cams that drive knitting needles of each needle bed to conduct a knitting operation is used. When knitting a knitting fabric opposing a knitting fabric into the intarsia pattern is knitted, the yarn extending from a knitting needle holding the final stitch of the intarsia pattern to the yarn feeding portion of the thread feeding member is hooked on an unused knitting needle. Hooking and release of the hooked yarn are performed alternately.

Furthermore, the invention provides an apparatus for generating a knitting program for an intarsia pattern knitting fabric that generates a knitting program for knitting a cylindrical knitting fabric in which a front knitting fabric and a back knitting fabric are joined on both ends with an intarsia pattern inserted. The knitting is performed using an automatic flat knitting machine while halting the thread feeding member for feeding the yarn used for knitting the intarsia pattern near a final stitch of the intarsia pattern for each knitting course of the intarsia pattern, and the knitting program is based on input of a predetermined control code. The automatic flat knitting machine includes a tooth mouth formed between a plurality of opposing needle beds, and a plurality of thread feeding members for feeding a yarn to the tooth mouth while traveling in a longitudinal direction of the needle beds, and the knitting machine is able to displace a position at which the yarn is fed from the thread feeding member to the tooth mouth between before and after (i.e., during) knitting of the intarsia pattern.

The apparatus includes an intarsia knitting detecting means for detecting whether or not there is a control code instructing an intarsia pattern knitting in input control codes; and a control inserting means for inserting a control operation in which a knitting fabric opposing a knitting fabric into which the intarsia pattern is knitted is knitted in a state where a yarn extending from the knitting needle holding the final stitch of the intarsia pattern to a yarn feeding portion of the thread feeding member is hooked on an unused knitting needle on a needle bed opposing a needle bed to which the knitting needle belongs, and the hooked yarn is released after knitting the knitting fabric. The control inserting means inserts the control operation when a control code instructing intarsia pattern knitting is detected by the intarsia knitting detecting means.

BRIEF DESCRIPTION OF DRAWINGS

The objects, features and advantages will be clarified with reference to the following detailed description with reference to the following drawings.

DETAILED DESCRIPTION OF THE INVENTION

Hereinafter, preferable examples of the present invention will be described more specifically with reference to the drawings.

Figure 1:
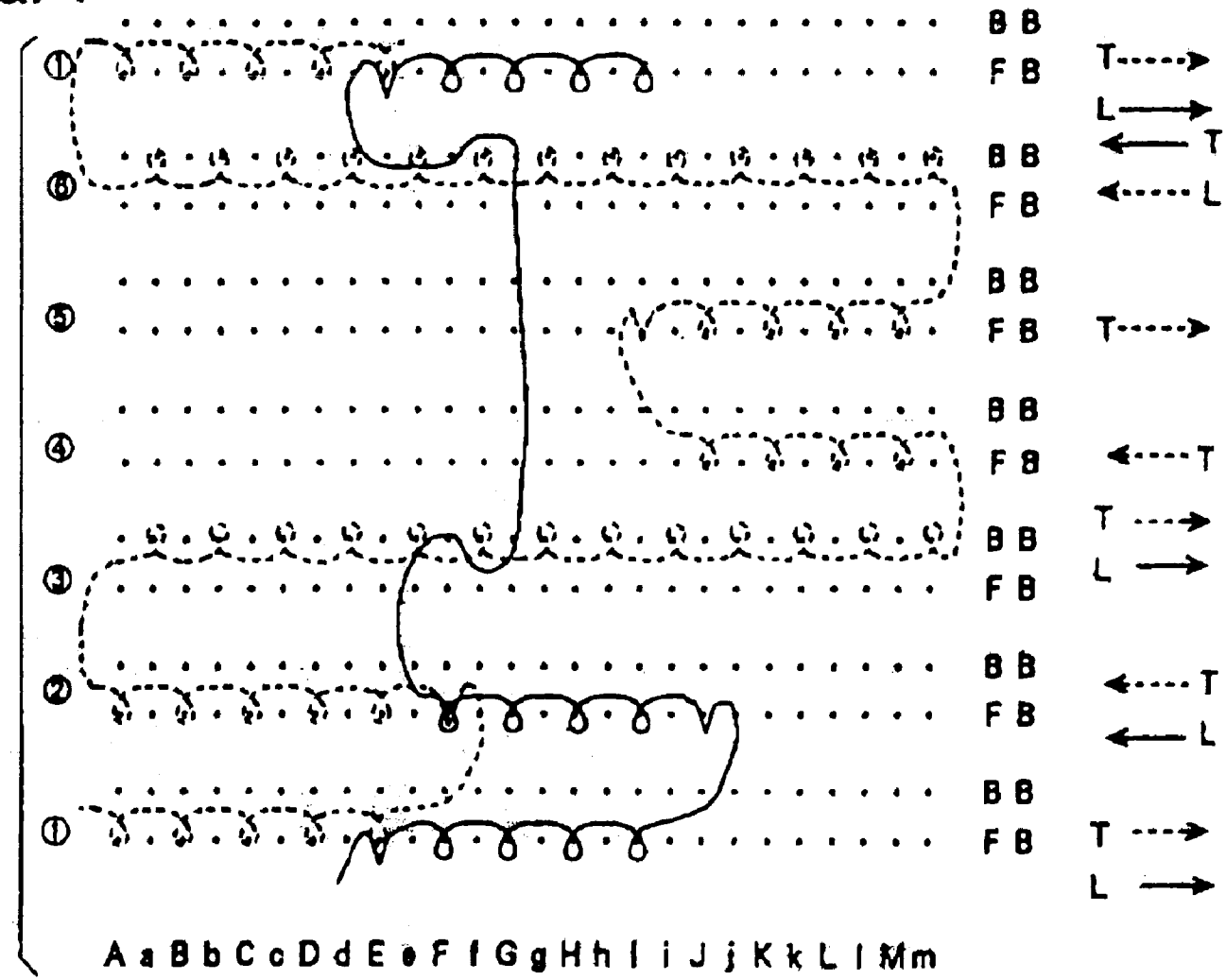
FIG. 1 is a detailed knitting view showing a method for knitting an intarsia pattern knitting fabric as one embodiment of the present invention.
Figure 7:
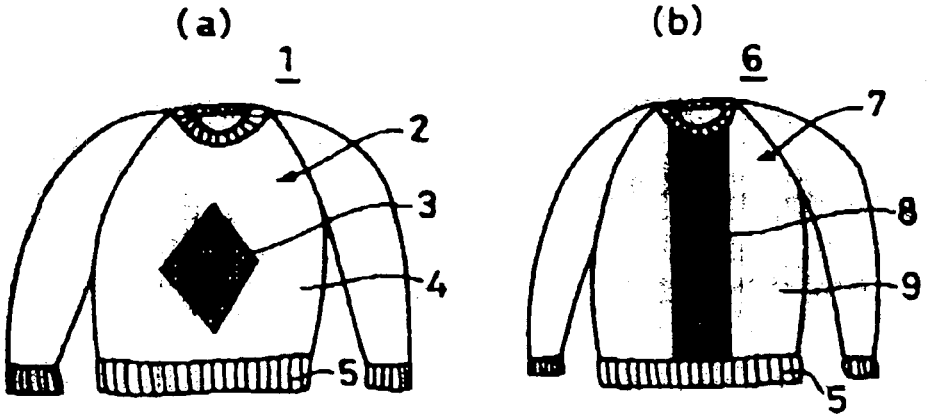
FIG. 7 is a view showing the appearance of the cylindrical knitting fabric having an intarsia pattern.
Figure 8:
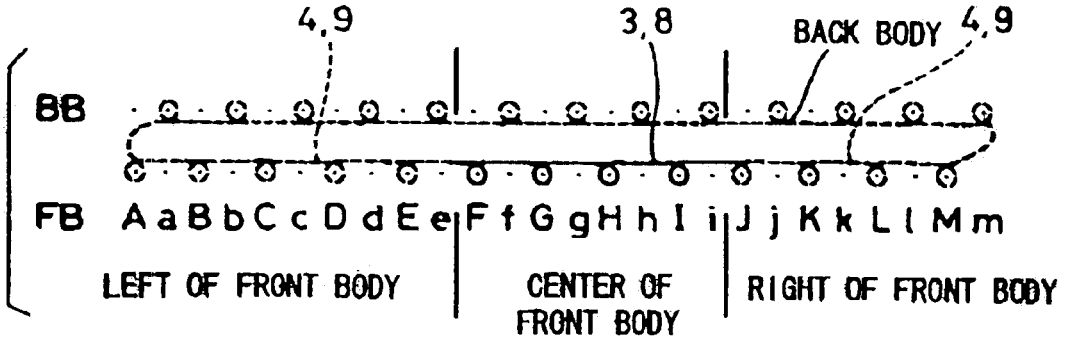
FIG. 8 is a view showing a state in which a knitting needle is used when knitting the cylindrical knitting fabric of FIG. 7 with a double bed flat knitting machine.
Figure 9:
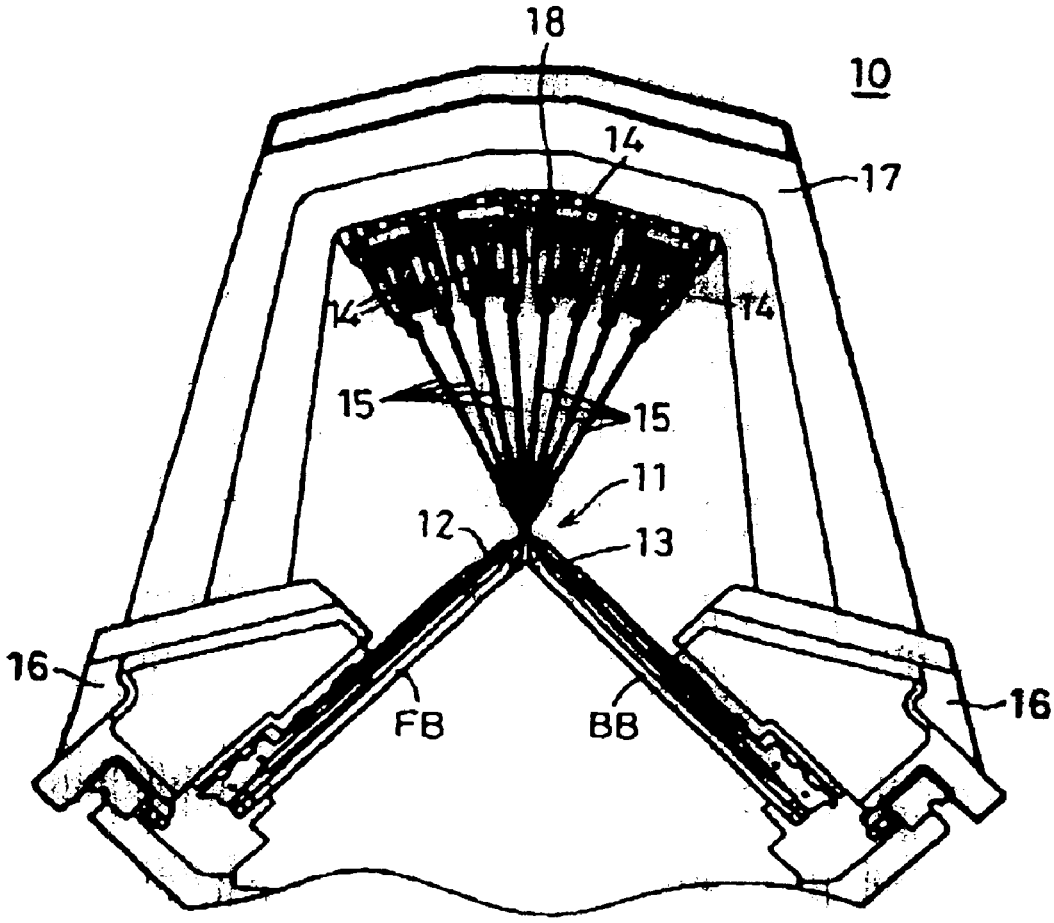
FIG. 9 is a side cross-sectional view of a double bed flat knitting machine.

FIG. 1 shows a detailed knitting state in a case where the intarsia patterns 3 and 8 are knitted with a double bed flat knitting machine so as to have front bodies 2 and 7 of cylindrical knitting fabrics as shown in FIG. 7. For simplification, this will be described with a reduced number of knitting needles used for knitting each portion. For knitting the front knitting fabric such as the front body, knitting needles A, B, C, D, . . . , which are shown by capital letters and present in every second line, are used. For knitting the back knitting fabric such as the back body, knitting needles a, b, c, d, . . . , which are shown by lower case letters and present in every second line, are used. It is assumed that in each needle bed, the capital knitting needles A, B, C, D, . . . are positioned at the odd numbered line from the left, for example, and the lower case knitting needles a, b, c, d, . . . are positioned at the, even numbered line.

Figure 10:
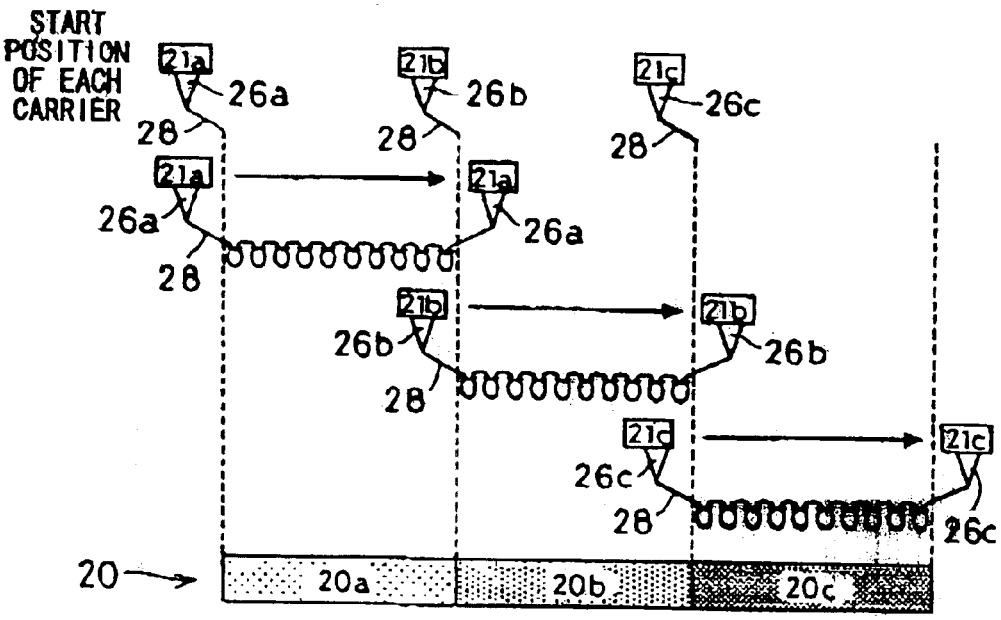
FIG. 10 is a view showing a state in which the intarsia pattern is knitted using the normal carrier and the intarsia carrier in compassion.
Figure 10:
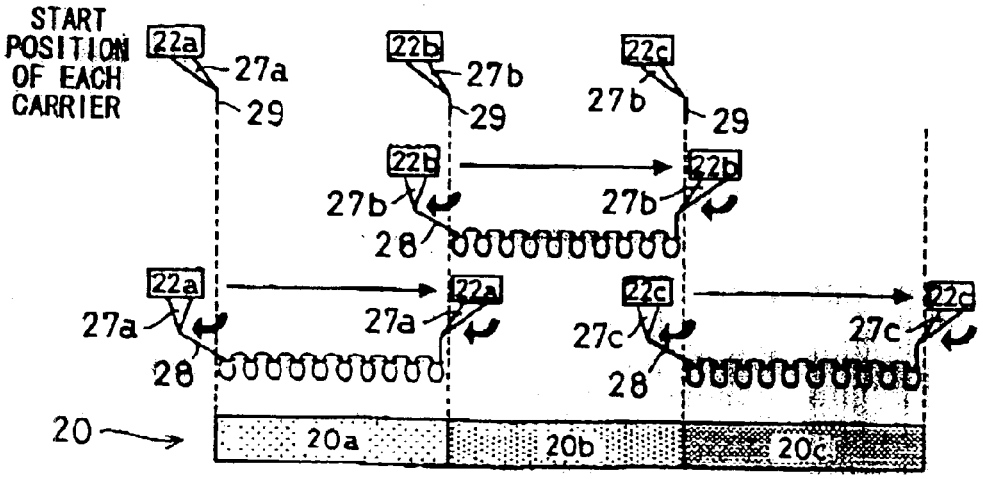

A carriage that can activate two sets of cams for each needle bed is used. In a movement in one direction of the carriage, the cam on the leading system side is taken as an L side, and the cam on the trailing system side is taken as a T side. When the carriage moves in the other direction, the leading system and the trailing system are switched. As the yarn carrier, an intarsia carrier as shown in FIG. 10(*b*) is used as the yarn carrier. The carriage disclosed in Japanese Examined Patent Publication JP-B2 61-51061 is provided with a pin for switching the displacement of a yarn feeding portion, in addition to the transfer pin for engaging the intarsia carrier. Swing displacement of the yarn feeding portion can be performed by the transfer pin, and each pin is arranged in accordance with the position of each cam. In this embodiment, movement of six courses (shown by ① to ⑥) of the carriage constitutes one cycle, and in one cycle, a knitting fabric of two courses can be knitted.

In the first course of the carriage movement, the carriage is moved from the left end to a point toward the right, and the front body is divided into the intarsia pattern portion and the ground left side portion. The intarsia pattern portion is knitted by the knitting needles F, G, H and I using the cam on the L side, and the ground left side portion is knitted by the knitting needles A, B, C, D and E using the cam on the T side. As shown by a solid line, the left end of the yarn used in knitting the intarsia pattern portion is tucked for being joined to the knitting needle E on the right end of the ground left portion shown by a broken line. Thus, the first course of the intarsia pattern and the ground left side portion is knitted.

In the second course of the carriage movement, the carriage is moved from the point toward the right to the left end, and the front body is divided into the intarsia pattern portion and the ground left side portion. The intarsia pattern portion is knitted by the knitting needles I, H, G and F using the cam on the L side, and the ground left side portion is knitted by the knitting needles E, D, C, B and A using the cam on the T side. The right end of the yarn knitting the intarsia pattern portion is tucked for being joined to the knitting needle J on the left end of the ground right portion. The right end of the yarn knitting the ground left portion is tucked for joining to the knitting needle F on the left end of the intarsia pattern portion. Thus, the second course of the intarsia pattern and the ground left side portion is knitted.

Figure 11:
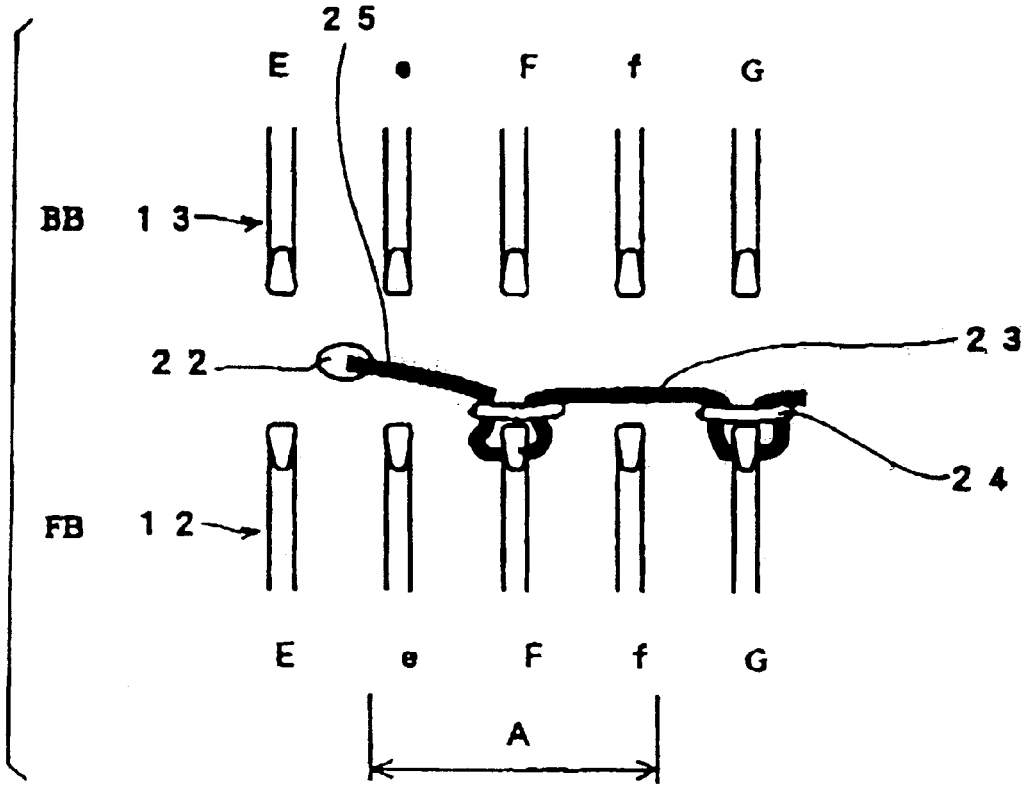
FIG. 11 is a plan view partially showing the range in which yarn entanglement does not occur with the intarsia carrier.

In the third course of the carriage movement, the carriage is moved from the left end to the right end. While the back body for knitting needles a, b, c, d, e, f, g, h, i, j, k, l, and m is knitted with the cam on the T side, a kick-back of moving the intarsia carrier to the right side of the knitting needle F with the pin on the L side is performed, and the yarn extending from the knitting needle F on the left end of the intarsia pattern to the yarn feeding portion of the intarsia carrier is hooked on an unused knitting needle F in the back needle bed by the cam on the L side. The yarn is hooked by the leading cam on the L side, so that when knitting the back body by the cam on the T side, the yarn from the knitting needle F that is in the left end of the intarsia pattern in the front needle bed FB extends to the yarn feeding portion of the intarsia carrier via the knitting needle F of the back needle bed BB. Thus, even if the precision is such that the halt position of the yarn feeding portion is outside the range A of FIG. 11, yarn entanglement hardly occurs. In this manner, the first course of the ground of the back body is knitted.

In the fourth course of the carriage movement, the carriage is moved from the right end to a point toward the left, and the right side portion of the ground of the front body for knitting needles M, L, K, and J is knitted with the cam on the T side. In the fifth course of the carriage movement, the carriage is moved from the point toward the left to the right end, and the right side portion of the front body for knitting needles J, K, L, and M is knitted with the cam on the T side. The left end of the yarn knitting the right side portion of the ground of the front body is tucked for being joined to the knitting needle I on the right end of the intarsia pattern. In this manner, the first and the second courses of the right side portion of the ground of the front body are knitted.

In the sixth course of the carriage movement, the carriage is moved from the right end to the left end. While the ground of the back body for knitting needles m, l, k, j, i, h, g, f, e, d, c, b, and a is knitted with the cam on the L side, a kick-back of moving the intarsia carrier to the left side of the knitting needle F with the pin on the T side is performed, and a shake-off of releasing the hooked yarn by proceeding and receding the knitting needle F on the back needle bed by the cam on the T side is performed. In this manner, the second course of the ground of the back body is knitted, and the hooked yarn on the knitting needle F on the back needle bed is released.

Figure 2:
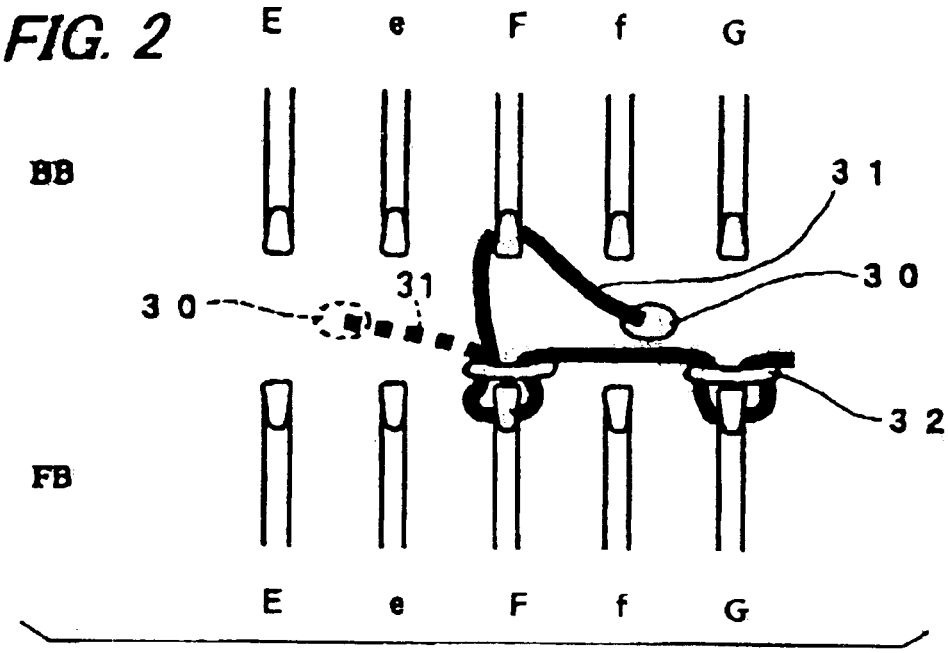
FIG. 2 is a plan view partially showing a state in which a yarn is hooked on the back needle bed in the third course in the carriage movement of FIG. 1.
Figure 3:
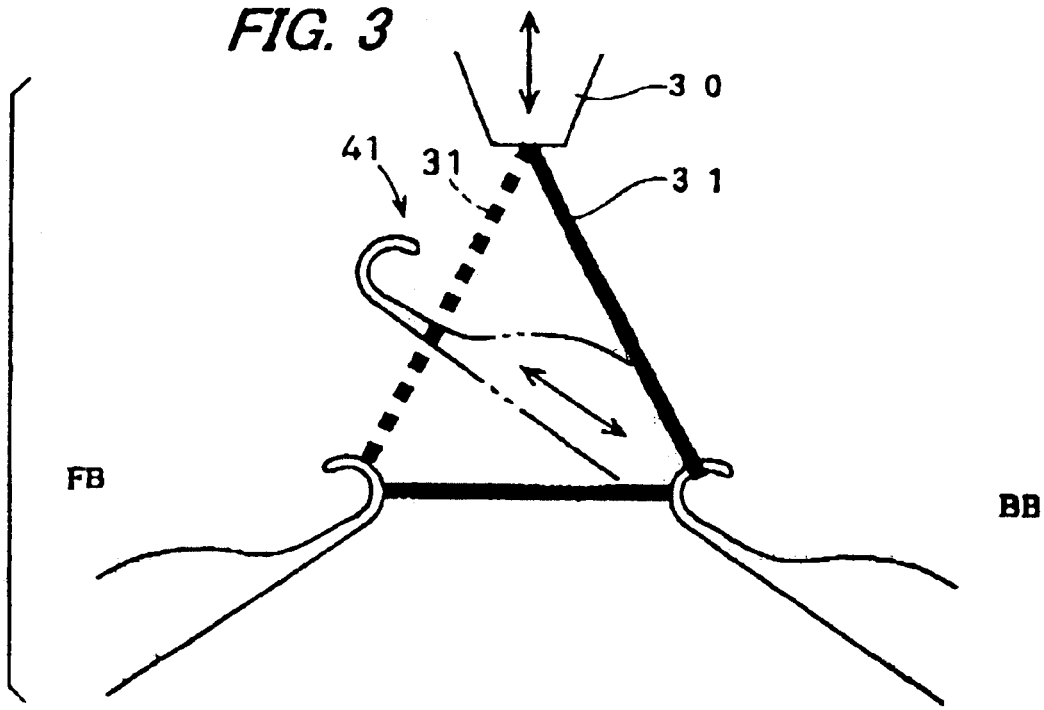
FIG. 3 is a right side view of FIG. 2.

FIGS. 2 and 3 show the principle that can prevent yarn entanglement when the yarn is hooked on the opposing needle bed in the course of knitting, as in this embodiment. As shown in FIG. 2, in the third course of the carriage movement of FIG. 1, as shown by a broken line, the yarn 31 extending from the knitting needle F on the left end of the intarsia pattern knitted in the front needle bed FB to the yarn feeding portion 30 is hooked on the knitting needle F on the back needle bed BB as shown by a solid line, in cooperation with the kick-back of the yarn feeding portion 30. Herein, "hook" refers to an operation of only catching the yarn 31 with a knitting needle, and does not include knocking over an old loop 32 as the knitting needles F and G on the front needle bed FB. As shown in FIG. 3, the yarn 31 extending from the knitting needle F on the back needle bed BB to the yarn feeding portion 30 is hardly caught even if another knitting needle on the back needle bed BB side is projected to the tooth mouth (i.e., needle gap) 41, as shown by a phantom line. When the yarn 31 extends from the knitting needle F on the front needle bed FB to the same yarn feeding portion 30, as shown by the broken line, the yarn is caught easily by the knitting needle projecting from the back needle bed BB to the tooth mouth 41. This difference makes it possible to prevent yarn entanglement in this embodiment.

When the knitting needle F on the back needle bed BB opposing the knitting needle F on the front needle bed FB is not unused, the yarn can be hooked on another knitting needle that is unused on the back needle bed BB. Furthermore, when the intarsia patterns (for example, diamond patterns) are arranged in the lateral direction, a plurality of intarsia carriers are halted near each other. In this case, it is preferable to select an unused knitting needle to be hooked so that the intarsia carriers are as apart (far away from each other) as possible. The yarn extending between the knitting needle F on the front needle bed FB and an unused knitting needle on the back needle bed is located in a low position, so that it is not caught by another knitting needle. Furthermore, when the catching amount of the knitting needle F on the back needle bed BB that hooks the yarn 31 with a stitch cam is set to be large, the yarn 31 extending from this knitting needle F to the yarn feeding portion 30 separates from the hook, so that yarn entanglement can be prevented more reliably.

Figure 4:
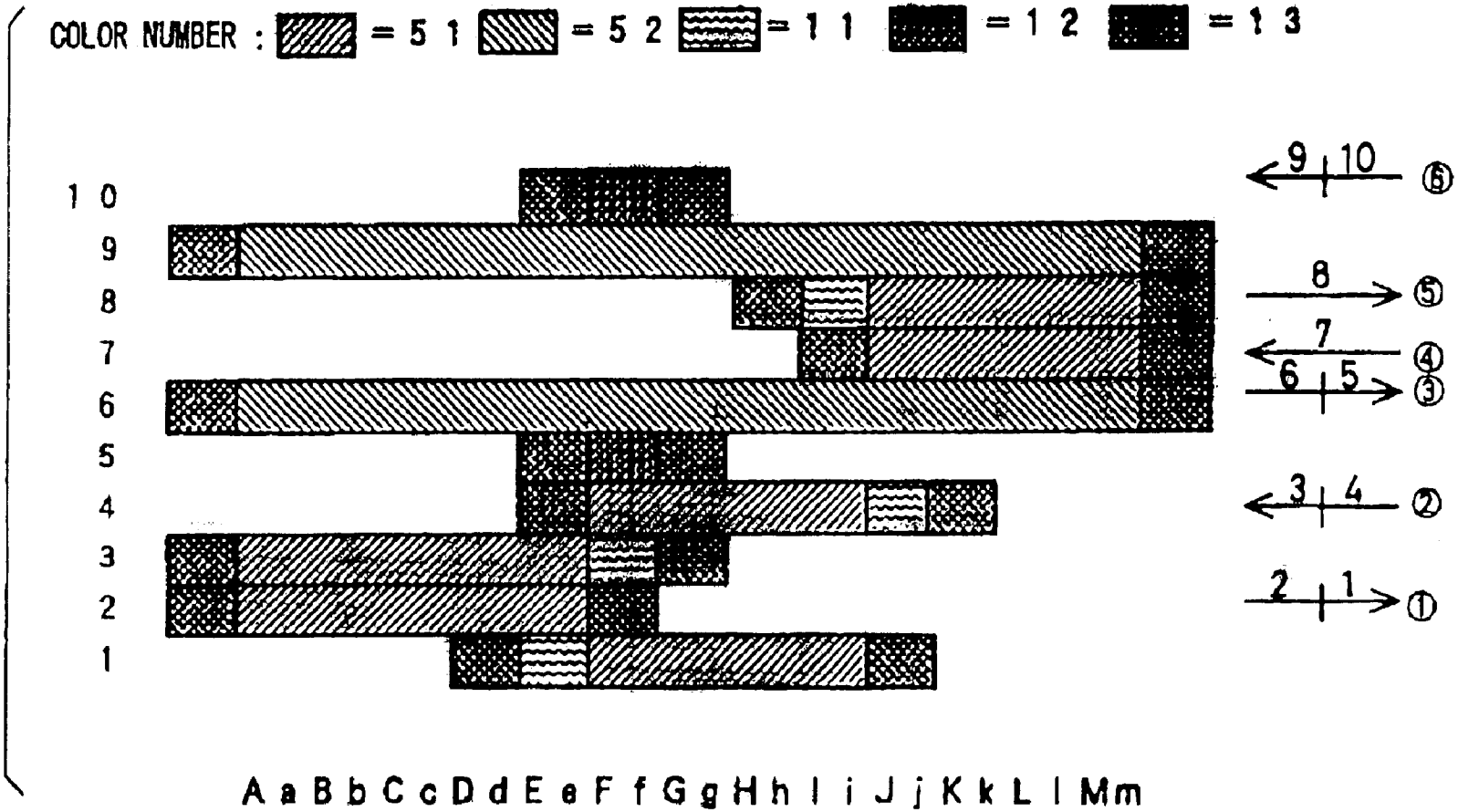
FIG. 4 is a view showing pattern data corresponding to the knitting method of FIG. 1.

FIG. 4 shows an example instructing generation of a knitting program for performing knitting as shown in FIG. 1 with an automatic flat knitting machine, utilizing pattern data in which texture patterns are linked to the color numbers. Such a knitting program is generated by inputting control codes designating stitches with the color number, using the course of the knitting fabric that is knitted by an operator in a CAD apparatus as a unit. For example, the color number 51 indicates front knitting (front calico, front stitches of stockinette), the color number 52 indicates back knitting (back calico, back stitches of stockinette), the color number 11 indicates the front tuck, and the color number 12 indicates the back tuck. The color number 13 is a pattern spread point and indicates a range in which the intarsia carrier led by the transfer pin is moved. On the right side, the courses ① to ⑥ of the carriage movement of FIG. 1 are shown correspondingly. The intarsia pattern can be inserted in two or more portions of the front body or the back body. In the fifth course and the tenth course, the intarsia pattern knitting on the front needle bed is detected so as to make automatic insertion possible.

Figure 5:
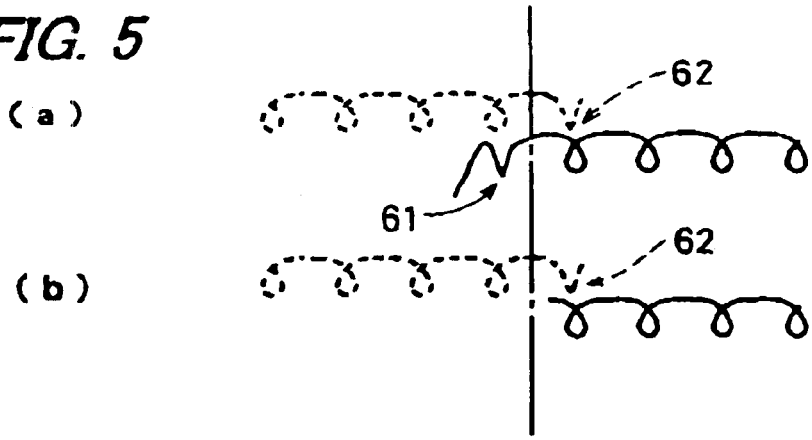
FIG. 5 is a knitting view partially showing a joining method in the boundary when knitting the intarsia pattern knitting fabric as shown in FIG. 1.

FIG. 5 shows a method for joining the knitting fabrics in the boundary of the intarsia pattern. A joining method with tucks 61 and 62 on both sides as shown in FIG. 5(*a*) is described with reference to the detailed knitting of FIG. 1. A joining method using a tuck 61 on one side as shown in FIG. 5(*b*) can be utilized. In the case of joining with a tuck on one side, the intarsia pattern can be knitted in a simpler manner.

Figure 6:
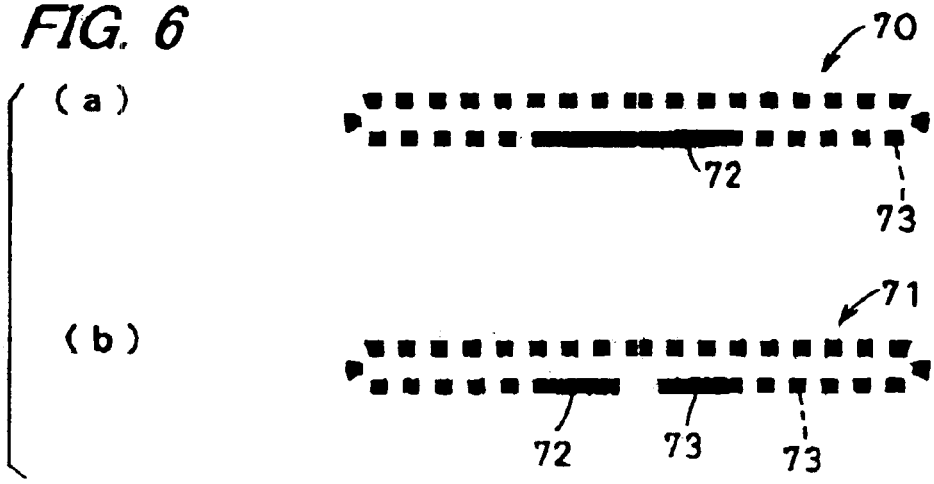
FIG. 6 is a view showing a cross-sectional shape of a cylindrical knitting fabric that can be knitted by applying the present invention.

FIG. 6 shows the cross-sectional shape of the cylindrical knitting fabric that can be knitted by applying the present invention. FIG. 6(*a*) shows a complete cylindrical knitting fabric 70, such as a sweater as shown in the detailed knitting of FIG. 1. FIG. 6(*b*) shows a cylindrical knitting fabric 71 that is partially separated, such as a cardigan. Each cylindrical knitting pattern 70 or 71 has the intarsia pattern portion 72 and the ground portion 73. In even such a separate cylindrical knitting fabric 71, the knitting fabric with the intarsia pattern can be knitted efficiently by applying the invention.

In the case where the width of the intarsia pattern is increased gradually and decreased gradually as in the intarsia pattern knitting fabric 3 of a diamond pattern shown in FIG. 7(*a*), the intarsia pattern can be knitted in the same manner as in the case of the intarsia pattern knitting pattern 8, in which the width of the pattern is constant as shown in FIG. 7(*b*). In order to knit an intarsia pattern in which the knitting width is changed rapidly in a stepwise manner in the front body, knitting is first finished by the method as described above, and knitting is performed in the back body in this state, and knitting can proceed while performing a front tuck up to the starting point of the course immediately before the next course.

A band-like region such as the intarsia pattern knitting fabric 8 shown in FIG. 7(*b*) can be knitted with a different yarn to make this region stronger than other knitting fabrics because this is a knitting fabric provided with button holes of a cardigan. Such a knitting fabric region is knitted using another carrier than other knitting fabrics, so that it is necessary to halt the carrier in the boundary and it is necessary to prevent yarn entanglement when knitting the opposing knitting fabric. In order to prevent yarn entanglement, the present invention can be applied. In addition to the cylindrical knitting fabric, in the case where knitting fabrics are partially opposed to each other in a pocket or the like, the invention can be applied to that portion. Thus, "intarsia pattern" to which the invention can be applied includes not only a knitting fabric region as decoration, but also includes a portion for which it is necessary to halt the carrier in the boundary of regions knitted with different yarns to knit the opposing knitting fabrics. Furthermore, the invention also can be applied in the case where an intarsia pattern is present in the back knitting fabric of a cylindrical knitting fabric and the front knitting fabric is to be knitted, or in the case where intarsia patterns are present in the knitting fabrics on both sides.

In the above description, intarsia carriers of a swing type for swinging and displacing the position of the yarn feeding portion 30 are used for intarsia knitting. The invention can be performed in the same manner, as long as vertical movement or horizontal movement of the yarn feeding portion of the thread feeding member is provided. For example, the invention also can be applied to a case in which a flat knitting machine having a steel band for the kick-back of the carrier is suspended on a thread guiding rail, and can be moved horizontally by a motor, is combined with a carrier that can move vertically, as disclosed in Japanese Patent Publication 2903152.

Furthermore, the cylindrical knitting fabric can be knitted without allocating knitting needles every other line, when a four-bed flat knitting machine having a front needle bed and a back needle bed each in two stages of the upper and the lower stages is used. When the yarn extending between the halted intarsia carrier and the knitting needle is hooked on an unused knitting needle on the needle bed side to which the knitting needle used for knitting belongs, yarn entanglement can be prevented.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

INDUSTRIAL APPLICABILITY

As described above, according to the invention, a cylindrical knitting fabric in which the front knitting fabric and the back knitting fabric are joined on both ends is knitted using a flat knitting machine which can displace the position of the yarn feeding portion. The yarn extending from the yarn feeding portion of the thread feeding member that is used for knitting an intarsia pattern portion and is halted near the boundary of the intarsia pattern to the knitting needle that holds the final stitch of the intarsia pattern is hooked on an unused knitting needle on the needle bed opposing the needle bed to which the knitting needle that holds the final stitch of the intarsia pattern belongs, when knitting the knitting fabric opposing the knitting fabric into which the intarsia pattern is knitted. Therefore, yarn entanglement hardly occurs. It is not necessary to perform return knitting for divided knitting near the boundary of the intarsia pattern, and the quality of the knitting fabric can be improved, and the production cost can be reduced.

Furthermore, according to the invention, the knitting needle is used alternately for knitting a front knitting fabric and for knitting a back knitting fabric even in a double bed flat knitting machine. Therefore, a rib knitting texture in which front stitches and back stitches are mixed can be formed in each knitting fabric. It is highly possible that individual stitches of the knitting fabric on one side is held by a knitting needle that belongs to either one of the front and the back needle beds, and the knitting needle of the opposing needle bed is unused, so that an unused needle to be hooked can be found easily.

According to the invention, the yarn is hooked on an unused knitting needle that is on the opposing needle bed near the knitting needle holding the final stitch of the intarsia pattern. Therefore, the range in which the yarn extends is limited to the periphery of the knitting needle holding the final stitch, so that yarn entanglement can be prevented sufficiently.

According to the invention, using a carriage provided with a plurality of sets of cams, the hooking of the yarn extending from the knitting needle holding the final stitch of the intarsia pattern to the yarn feeding portion of the thread feeding member, and the release of the hooking are performed when knitting a knitting fabric opposing the knitting fabric into which the intarsia pattern is knitted. Therefore, yarn entanglement can be prevented without compromising the productivity.

According to the invention, a knitting program for knitting a cylindrical knitting fabric in which the front knitting fabric and the back knitting fabric are joined on both ends with an intarsia pattern inserted, using an automatic flat knitting machine provided with a function for displacing the position of the yarn feeding portion between before and after an intarsia pattern can be generated based on inputs of control codes. A control inserting means inserts a control operation that is performed in a state in which the yarn extending from the knitting needle holding the final stitch of the intarsia pattern to the yarn feeding portion of the thread feeding member is hooked on an unused knitting needle on the needle bed used for knitting the opposing knitting fabric, when knitting the knitting fabric opposing the knitting fabric into which the intarsia pattern is knitted. Therefore, a knitting program that prevents yarn entanglement can be generated. It is not necessary to perform return knitting or the like in order to prevent yarn entanglement, so that the stitches can be uniform and the production cost can be reduced.

What is claimed is:

1. A method of knitting an intarsia pattern knitting fabric, said method comprising:

providing a flat intarsia knitting machine having a plurality of thread feeding members, the flat intarsia knitting machine being operable to displace a position at which a yarn is fed from any one of the thread feeding members to a needle gap during intarsia knitting, the needle gap being formed between a plurality of opposing needle beds;

using the thread feeding members to feed yarn to the needle gap of the flat intarsia knitting machine while traveling along a longitudinal direction of the opposing needle beds so as to knit a cylindrical knitting fabric in which a front knitting fabric and a back knitting fabric are joined at both ends with an intarsia pattern inserted therein;

halting the thread feeding members for feeding the yarn at a final stitch of the intarsia pattern after knitting the intarsia pattern;

knitting a knitting fabric opposing the knitting fabric into which the intarsia pattern is knitted such that a yarn extending from a knitting needle holding the final stitch of the intarsia pattern to a yarn feeding portion of any of the thread feeding members is hooked on an unused knitting needle on one of the needle beds opposing the other of the needle beds to which the knitting needle belongs; and releasing the hooked yarn after knitting the knitting fabric opposing the knitting fabric into which the intarsia pattern is knitted.

2. The method of claim 1, wherein said knitting of the cylindrical knitting fabric comprises alternately allocating knitting needles of each of the opposing needle beds to knit a front knitting fabric and to knit a back knitting fabric in a double bed flat knitting machine in which one of the needle beds is arranged on each side of the needle gap.

3. The method of claim 1, wherein the unused knitting needle is a knitting needle of one of the needle beds opposing the other of the needle beds to which the knitting needle holding the final stitch belongs.

4. The method of claim 1, further comprising providing a carriage having a plurality of sets of cams for driving knitting needles of each of the needle beds so as to perform a knitting operation, wherein said knitting of the knitting fabric opposing the knitting fabric into which the intarsia pattern is knitted comprises alternately hooking the yarn extending from the knitting needle holding the final stitch of the intarsia pattern to the yarn feeding portion of any of the thread feeding members on an unused knitting needle and releasing the hooked yarn.

5. An apparatus for generating a knitting program for an intarsia pattern knitting fabric, the intarsia pattern knitting fabric comprising a cylindrical knitting fabric in which a front knitting fabric and a back knitting fabric are joined on both ends with an intarsia pattern inserted therein, said apparatus to be used with an automatic flat knitting machine including a needle gap arranged between opposing needle beds, and including a plurality of thread feeding members operable to feed yarn to said needle gap while traveling in a longitudinal direction of said needle beds, any of said thread feeding members being operable to halt at a final stitch of the intarsia pattern for each knitting course of the intarsia pattern based on a predetermined control code, said automatic flat knitting machine being operable to displace a position at which the yarn is fed by any of said thread feeding members to said needle gap during knitting of the intarsia pattern; said apparatus comprising:

an intarsia knitting detecting device for detecting the presence of a control code with instructions for intarsia pattern knitting; and a control inserting unit for inserting, into a knitting operation, a control operation for controlling said automatic flat knitting machine so that, when said intarsia knitting detecting device detects the control code with instructions for intarsia pattern knitting, said automatic flat knitting machine knits a knitting fabric opposing the knitting fabric into which the intarsia pattern is knitted such that a yarn extending from a knitting needle holding the final stitch of the intarsia pattern to a yarn feeding portion of any of said thread feeding members is hooked on an unused knitting needle on one of said needle beds opposing the other of said needle beds to which said knitting needle belongs, and such that the hooked yarn is released after knitting the knitted fabric.

* * * * *

UNITED STATES PATENT AND TRADEMARK OFFICE

CERTIFICATE OF CORRECTION

PATENT NO. : 6,857,294 B2
DATED : February 22, 2005
INVENTOR(S) : Kazuyoshi Okamoto It is certified that error appears in the above-identified patent and that said Letters Patent is hereby corrected as shown below:

Title page,
Item [54], Title, "METHOD FOR KNITTING INTARSIA PATTERN KNITTING FABRIC AND KNITTING PROGRAM PRODUCING DEVICE THEREFOR" to -- METHOD FOR KNITTING INTARSIA PATTERN KNITTING FABRIC AND APPARATUS FOR GENERATING KNITTING PROGRAM --.

Signed and Sealed this

Seventeenth Day of May, 2005

JON W. DUDAS
*Director of the United States Patent and Trademark Office*